US008968037B2

(12) United States Patent
Boe et al.

(10) Patent No.: US 8,968,037 B2
(45) Date of Patent: Mar. 3, 2015

(54) SUBSEA CONTAINER ELECTRICAL THROUGH CONNECTOR

(75) Inventors: Ove Boe, Tanem (NO); Günter Harbecke, Mömbris (DE); Frode Johansen, Trondheim (NO); Torbjoern Stroemsvik, Trondheim (NO)

(73) Assignee: Siemens Aktiengesellschaft, Munich (DE)

( * ) Notice: Subject to any disclaimer, the term of this patent is extended or adjusted under 35 U.S.C. 154(b) by 67 days.

(21) Appl. No.: 13/825,884

(22) PCT Filed: Feb. 9, 2011

(86) PCT No.: PCT/EP2011/051855

§ 371 (c)(1),
(2), (4) Date: Jun. 11, 2013

(87) PCT Pub. No.: WO2012/038102

PCT Pub. Date: Mar. 29, 2012

(65) Prior Publication Data

US 2013/0252482 A1 Sep. 26, 2013

(30) Foreign Application Priority Data

Sep. 24, 2010 (EP) ..... 10179453

(51) Int. Cl.
*H01R 13/40* (2006.01)
*H01R 13/533* (2006.01)
(Continued)

(52) U.S. Cl.
CPC ..... *H01R 13/533* (2013.01); *E21B 33/0385* (2013.01); *H01R 4/56* (2013.01); *H01R 13/523* (2013.01)
USPC ..... 439/750

(58) Field of Classification Search
USPC ..... 439/750, 283–284, 559; 174/151, 174/50.61, 65 R, 152 R, 153 G
See application file for complete search history.

(56) References Cited

U.S. PATENT DOCUMENTS 3,352,963 A 11/1967 Homrig ..... 174/151
3,843,832 A * 10/1974 Petersen et al. ..... 174/151
(Continued)

FOREIGN PATENT DOCUMENTS

GB 902318 A 8/1962 ..... H01L 23/40
GB 2044538 A 10/1980 ..... H01H 33/18
(Continued)

OTHER PUBLICATIONS

International Search Report and International Preliminary Report on Patentability, Application No. PCT/EP2011/051855, 9 pages, Jun. 6, 2011.
(Continued)

*Primary Examiner* — Jean F Duverne
(74) *Attorney, Agent, or Firm* — King & Spalding L.L.P.

(57) ABSTRACT

A subsea container electrical through connector for providing an electrical connection from an interior of a subsea container to an exterior of the subsea container is disclosed, wherein the connector extends partially into or fully through a hole in a subsea container. The connector comprises a conductive bolt having a conical bolt portion with an outer diameter increasing in a longitudinal direction. Further, the connector comprises an electrical insulator having a conical insulator portion with an inner surface, facing the conical bolt portion of the bolt, and an outer surface having an outer diameter which increases in the longitudinal direction.

16 Claims, 2 Drawing Sheets

(51) Int. Cl.

| | |
|---|---|
| ***E21B 33/038*** | (2006.01) |
| ***H01R 4/56*** | (2006.01) |
| ***H01R 13/523*** | (2006.01) |

(56) References Cited

U.S. PATENT DOCUMENTS

| | | | | |
|---|---|---|---|---|
| 3,904,815 | A * | 9/1975 | Bamberger et al. | 174/151 |
| 5,644,104 | A * | 7/1997 | Porter et al. | 174/92 |
| 6,321,779 | B1 * | 11/2001 | Miller et al. | 137/340 |
| 6,628,024 | B1 * | 9/2003 | Mirmobin | 310/71 |
| 6,844,502 | B2 * | 1/2005 | Deng et al. | 174/151 |
| 7,226,303 | B2 * | 6/2007 | Shaikh | 439/283 |
| 2006/0189208 | A1 | 8/2006 | Shaikh | 439/589 |

FOREIGN PATENT DOCUMENTS

| | | | | |
|---|---|---|---|---|
| WO | 2008/004084 | A1 | 1/2008 | E21B 41/00 |
| WO | 2012/038102 | A1 | 3/2012 | E21B 33/038 |

OTHER PUBLICATIONS

Russian Office Action, Application No. 2013118682, 15 pages, Aug. 29, 2014.

* cited by examiner

SUBSEA CONTAINER ELECTRICAL THROUGH CONNECTOR

CROSS-REFERENCE TO RELATED APPLICATIONS

This application is a U.S. National Stage Application of International Application No. PCT/EP2011/051855 filed Feb. 9, 2011, which designates the United States of America, and claims priority to EP Patent Application No. 10179453.5 filed Sep. 24, 2010 The contents of which are hereby incorporated by reference in their entirety.

TECHNICAL FIELD

The present disclosure relates to the field of subsea power distribution systems.

BACKGROUND

As is known from practice, switchgears of power distribution systems may be operated in sulfur hexafluoride.

Common electrical through connectors of land based containers containing the switchgear and the sulfur hexafluoride are not suitable for subsea operation.

In view of the above-described situation, there exists a need for an improved technique that enables to provide a subsea power transmission system, while substantially avoiding or at least reducing one or more of the above-identified problems.

SUMMARY

One embodiment provides a subsea container electrical through connector for providing an electrical connection from an interior of a subsea container to an exterior of the subsea container, the connector comprising: a bolt of a conducting material, the bolt having a conical bolt portion with an outer diameter increasing in a longitudinal direction; and an electrical insulator, the electrical insulator having a conical insulator portion with an inner surface, facing the conical bolt portion of the bolt, and an outer surface opposite the inner surface, the outer surface of the conical insulator portion having an outer diameter increasing in the longitudinal direction.

In a further embodiment, the bolt further comprises a front bolt portion defining a kink with the conical bolt portion, with an outer surface of the conical bolt portion and an outer surface of the front bolt portion abutting at the kink at an angle smaller than 180 degrees.

In a further embodiment, the front bolt portion has a constant outer diameter along the longitudinal direction.

In a further embodiment, the electrical insulator extending over the kink between the front bolt portion and the conical bolt portion of the bolt; and the electrical insulator having a smooth outer surface portion at the longitudinal position of the kink between the front portion and the conical bolt portion of the bolt.

In a further embodiment, the bolt further comprises a rear bolt portion defining a kink with the conical bolt portion, with an outer surface of the conical bolt portion and an outer surface of the rear bolt portion abutting at the kink at an angle larger than 180 degrees.

In a further embodiment, the rear bolt portion has a constant outer diameter along the longitudinal direction.

In a further embodiment, the electrical insulator extending over the kink between the conical bolt portion and the rear bolt portion of the bolt; and the electrical insulator further having a rear insulator portion extending at least partially over the rear bolt portion of the bolt.

In a further embodiment, the rear insulator portion has an outer diameter decreasing in the longitudinal direction.

In a further embodiment, the electrical insulator further comprising a step in its longitudinal profile.

In a further embodiment, at least the conical bolt portion of the bolt has a sandblasted outer surface.

In a further embodiment, the electrical insulator comprises or consists of epoxy.

In a further embodiment, the electrical insulator comprises or consists of ceramic.

Another embodiment provides a subsea container comprising a connector as disclosed above.

In a further embodiment, the connector extends to an interior of the subsea container filled with sulfur hexafluoride.

In a further embodiment, the connector also extends to an exterior of the subsea container which is pressurizeable, particularly up to 300 bar, while the interior of the subsea container is below 5 bar.

In a further embodiment, the subsea container is a pressure resistant container adapted to maintain an inside pressure that is lower than an external pressure when deployed subsea, wherein the connector penetrates through a wall of the container such that the longitudinal direction in which the outer diameter of the conical insulator portion increases extends from the inside of the container to the exterior of the container.

BRIEF DESCRIPTION OF THE DRAWINGS

Exemplary embodiments will be explained in more detail below on the basis of the schematic drawings, wherein.

DETAILED DESCRIPTION

Figure 1:
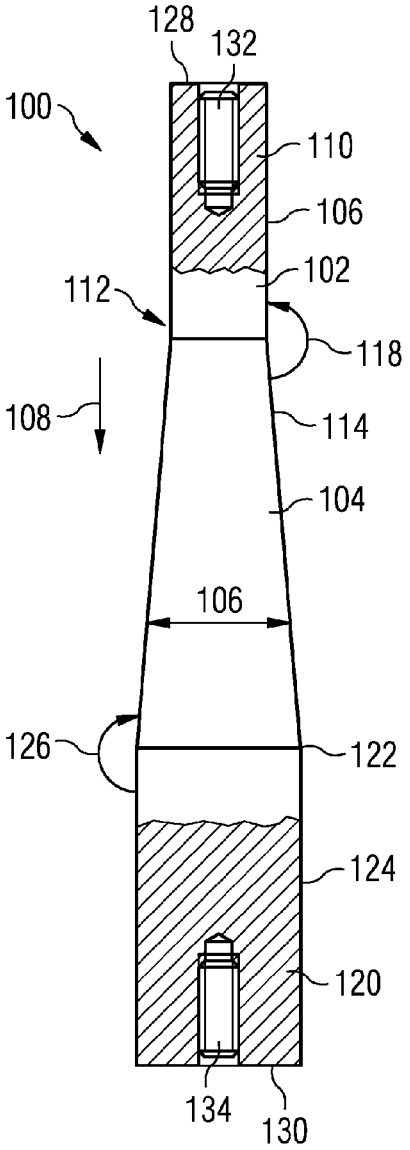
FIG. 1 shows a bolt of a subsea container electrical through connector in accordance with embodiments of the herein disclosed subject matter.

Some embodiments provide a subsea container electrical through connector, hereinafter also referred to as "connector" or "penetrator", for providing an electrical connection from an interior of a subsea container to an exterior of the subsea container, the connector comprising a bolt of a conducting material, the bolt having a conical bolt portion with an outer diameter increasing in a longitudinal direction; and an electrical insulator, the electrical insulator having a conical insulator portion with an inner surface, facing the conical portion of the bolt, and an outer surface opposite the inner surface, the outer surface of the conical insulator portion having an outer diameter increasing in the longitudinal direction.

This aspect is based on the idea that problems regarding tightness and material breakdown of electrical through connectors, that arise due to large pressure differences between interior and exterior of a subsea container, may be overcome with a connector in accordance with aspects and embodiments of the herein disclosed subject matter.

According to an embodiment, the bolt further comprises a front bolt portion defining a kink with the conical bolt portion, with an outer surface of the conical bolt portion and an outer surface of the front bolt portion abutting at the kink at an angle smaller than 180 degrees. The thus defined kink may, together with the isolator, provide for an increased retaining force preventing the connector from being squeezed through a hole in a container in which the connector is mounted.

According to a further embodiment, the front bolt portion has a constant outer diameter along the longitudinal direction. In other words, in this embodiment the front bolt portion has a cylindrical shape. This may assist in advantageous stress distribution.

According to a further embodiment, the electrical insulator extending over the kink between the front bolt portion and the conical bolt portion of the bolt, wherein the electrical insulator has a smooth outer surface portion at the longitudinal position of the kink between the front portion and the conical portion of the bolt. Such a configuration may result in an increased retention force of the bolt in the surrounding electrical insulator, as the electrical insulator is subjected to compressive forces if the bolt is pushed deeper into the electrical insulator (in a direction from the conical bolt portion to the front bolt portion).

According to a further embodiment, the bolt further comprises a rear bolt portion defining a kink with the conical bolt portion, with an outer surface of the conical bolt portion and an outer surface of the rear bolt portion abutting at the kink at an angle larger than 180 degrees. According to a further embodiment, the rear bolt portion has a constant outer diameter along the longitudinal direction. Hence, in an embodiment, the rear bolt portion is shaped cylindrically.

According to a further embodiment, the electrical insulator extends over the kink between the conical bolt portion and the rear bolt portion of the bolt. According to a further embodiment, the electrical insulator further has a rear insulator portion extending at least partially over the rear bolt portion of the bolt.

According to an embodiment, the rear insulator portion has an outer diameter decreasing in the longitudinal direction. This reduces the mass of the electrical insulator while still providing an advantageous stress distribution.

According to a further embodiment, the electrical insulator further comprises a step in its longitudinal profile.

According to a further embodiment, at least the conical bolt portion of the bolt has a sandblasted outer surface. According to other embodiments, the whole outer surface of the bolt is sandblasted. According to other embodiments, a roughened outer surface of the bolt is provided by other means. According to an embodiment, the roughness in z direction, i.e. in radial direction is Rz=30+20 mikrometer.

According to an embodiment, the electrical insulator comprises epoxy. According to another embodiment, the electrical insulator consists of epoxy. According to an embodiment, the electrical insulator comprises ceramic. According to a further embodiment, the electrical insulator consists of ceramic. According to an embodiment, the electrical insulator is a casted element, e.g. a casted tube. According to an embodiment, the electrical insulator is made of a hard material so as to provide high size accuracy and machinability.

According to an embodiment, the bolt consists of copper. According to other embodiments, other metals may be used as material for the bolt. If ceramic is used as an electrical insulator, the ceramic and the copper may be brazed together. According to other embodiments, other techniques are used, e.g. friction welding.

According to other embodiments, there is a loose connection between the electrical insulator and the bolt as long as no external pressure acts on the bolt, pressing the bolt into the electrical insulator. By using copper as bolt material in combination with the specified surface roughness of the conical bolt portion, good characteristics of the connector have been obtained.

According to an embodiment, a protective sleeve is mounted on the connector. A protective sleeve prevents damage of the isolator surface or contamination of the isolator surface.

According to a second aspect, a subsea container is provided, the subsea container comprising a connector according to the first aspect or an embodiment thereof. In accordance with an embodiment, the container comprises an interior and an exterior, opposite the interior. According to an embodiment, the interior of the container is defined by a container wall.

According to an embodiment, the connector extends to the interior of the subsea container. In accordance with an embodiment, the container is partially or completely filled with sulfur hexafluoride. Other filling materials are also possible, depending on the application. According to an embodiment, the container comprises an element, e.g. a switchgear, of an electricity network. According to an embodiment the rated voltage of the electricity network element and hence the rated voltage of the connector is 36 kilovolts. According to other embodiments, the rated voltage of the electricity network element higher and, in still other embodiments, lower. For example, in a further embodiment, the rated voltage is in a range between 10 kilovolts and 70 kilovolts, or, in another embodiment in a range between 50 kilovolts and 200 kilovolts, e.g. between 80 kilovolts and 140 kilovolts. In an embodiment, the rated current of the connector is 1 kiloampere (1 kA). In other embodiments, the rated current is in a range between 100 amperes and 4 kiloamperes. It should be noted that the connector must be capable of withstanding the rated voltage, the rated current as well as the pressure exerted under subsea installation conditions.

According to a further embodiment, the connector extends to an exterior of the subsea container which exterior is pressurizeable up to 300 bar while the interior of the subsea container is at a considerably lower pressure, e.g. below 10 bar, below 5 bar or below 2 bar, just to name some examples.

In a further embodiment, the subsea container is a pressure resistant container adapted to maintain an inside pressure that is lower than an external pressure when deployed subsea, wherein the connector penetrates through a wall of the container such that the longitudinal direction, in which the outer diameter of the conical insulator portion of the connector increases, extends from the inside of the container to the exterior of the container. For example, the outer diameter of the conical insulator portion increases from the interior of the container to the exterior of the container. The pressure difference between exterior and interior, i.e. the higher exterior pressure may push the connector against a seat formed by a conical through hole in the wall of the container which the connector penetrates, thereby improving the seal between connector and wall.

According to a further embodiment, the container is configured for installation at a seabed. For example, in respective embodiments the container is capable of being installed in a water depth below a predefined upper level, e.g. 100 meters (m), 800 meters, 2000 meters or 3000 meters with each upper level corresponding to a respective embodiment of the herein disclosed subject matter. According to respective further embodiments, the container is capable of being installed under a pressure corresponding to the specified depth, wherein in one embodiment the pressure is a pressure generated by sea water of the specified depth and in another embodiment the pressure is a pressure generated by fresh water of the specified depth. According to respective further embodiments, the container capable (i.e. is configured) for installation up to predefined lower level of water depth, e.g. 200 meters (m), 1000 meters, 3000 meters or 4000 meters with each lower level corresponding to a respective embodiment of the herein disclosed subject matter, leading to respective pressures which are dependent on the density of the water, e.g. on the temperature and on the type of water (sea water or fresh water).

In the above there have been described and in the following there will be described exemplary embodiments of the subject matter disclosed herein with reference to a subsea container electrical through connector and container including such a connector. It has to be pointed out that of course any combination of features relating to different aspects of the herein disclosed subject matter is also possible. In particular, some embodiments have been described with reference to connector claims whereas other embodiments have been described with reference to container claims. However, a person skilled in the art will gather from the above and the following description that, unless other notified, in addition to any combination of features belonging to one aspect also any combination between features relating to different aspects or embodiments, for example even between features of the connector claims and features of the container claims is considered to be disclosed with this application.

The aspects and embodiments defined above and further aspects and embodiments of the present invention are apparent from the examples to be described hereinafter and are explained with reference to the drawings, but to which the invention is not limited.

FIG. 1 shows a part of a subsea container electrical through connector 100, namely a copper bolt 102 in accordance with embodiments of the herein disclosed subject matter.

In accordance with an embodiment, the bolt 102 has a conical bolt portion 104 with an outer diameter 106 increasing in a longitudinal direction 108. A front bolt portion 110 defines a kink 112 with the conical bolt portion 104. An outer surface 114 of the conical bolt portion 104 and an outer surface 116 of the front bolt portion 110 abut at the kink 112 at an angle 118 which is smaller than 180 degrees, as shown in FIG. 1.

In an embodiment, the kink 112 is at a position up to which the through connector is inserted into the interior of the subsea container. In other words, this position indicates the thickness of the lid or canister housing into which the penetrator is mounted and the extent to which the connector penetrates into the interior of the container.

According to an embodiment, a rear bolt portion 120 is abutting the conical bolt portion 104, at a side opposite the front bolt portion 110. In accordance with an embodiment, the front bolt portion 104 and the rear bolt portion 120 are cylindrical.

In accordance with a further embodiment, the rear bolt portion 120 defines a kink 122 with the conical bolt portion 104 and the respective surfaces 114, 124 thereof abut at the kink 122 at an angle 126 which is larger than 180 degrees. According to an embodiment, the sum of the angles at both kinks 112, 122 is 360 degrees. According to other embodiments, the sum of the angles 112, 122 at both kinks is smaller, or in another embodiment, larger than 360 degrees.

In accordance with an embodiment, the faces 128, 130 of the bolt are flat. Flat faces 128, 130 facilitate a good electrical connection to a conductor (not shown) that may be attached to the bolt 102. According to an embodiment, the faces 128, 130 comprise a thread 132, 134, respectively, for mounting a conductor. It is important to ensure the necessary distance between the container wall (e.g. metal lid of the container) and the flat faces 128, 130 of the bolt 102 to give the necessary insulation level for the applied voltage.

According to an embodiment, the outer surface 114, 116, 124 of the bolt 102 has a predetermined surface roughness, e.g. a surface roughness as can be obtained by sandblasting the outer surface 114, 116, 124. In an embodiment, the roughness at the surface of the bolt is configured to ensure a secure adhesion between the bolt and the epoxy in the casting process.

Figure 2:
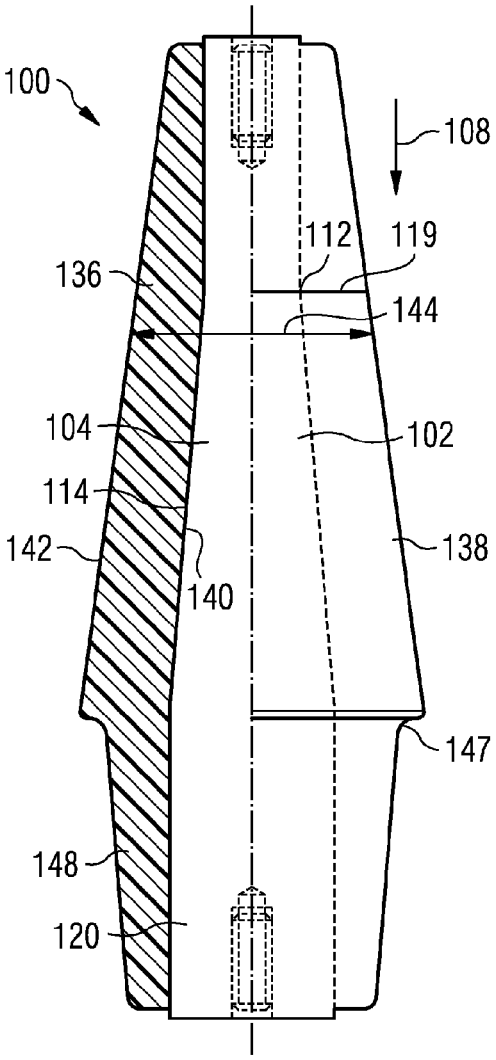
FIG. 2 shows the bolt of FIG. 1 with an electrical insulator, forming a subsea container electrical through connector in accordance with embodiments of the herein disclosed subject matter.

FIG. 2 shows a subsea container electrical through connector 100 (referred to as connector in the following) in accordance with embodiments of the herein disclosed subject matter.

In accordance with an embodiment, the connector 100 comprises the bolt 102 as described with regard to FIG. 1. In accordance with a further embodiment, the connector 100 comprises an electrical insulator 136 made of epoxy. In accordance with an embodiment, the electrical insulator 136 is a casted element. According to an embodiment, the epoxy is fixed to the bolt by the casting operation, e.g. by casting the epoxy around the bolt. According to an embodiment, the casting operation is a vacuum casting operation. Other methods of casting may also be applied.

The electrical insulator 136 has a conical insulator portion 138 with an inner surface 140 facing the conical portion 104 of the bolt and in particular its outer surface 114. An outer surface 142 is located radially opposite the inner surface 140. The outer surface 142 of the conical insulator portion 138 has an outer diameter 144 increasing in the longitudinal direction 108.

In accordance with an embodiment, the electrical insulator 136 extends over the kink 112 between the front bolt portion 110 and the conical bolt portion 104 of the bolt 102. In accordance with an embodiment, the outer surface 142 is smooth, in particular at the longitudinal position of the kink 112. For example, in an embodiment, the outer surface 142 is straight over the longitudinal position of the kink 112.

Generally herein, "longitudinal position" refers to a respective position along the longitudinal direction 108. In accordance with an embodiment, the conical insulator portion 138 extends over at least a part of the front bolt portion 110, as shown in FIG. 2. In an embodiment, the kink 112 is at a position up to which the through connector is inside a wall of the subsea container, this position being indicated by the horizontal line 119 in FIG. 2.

In accordance with a further embodiment, the electrical insulator 136 extends over the kink 122 between the conical bolt portion 104 and the rear bolt portion 120 of the bolt and comprises a step 147 in its longitudinal profile, i.e. in its profile along the longitudinal direction. The electrical insulator 136 further forms a rear insulator portion 148 extending at least partially over the rear bolt portion 120 of the bolt 102.

According to an embodiment, the rear insulator portion 148 has an outer diameter decreasing in the longitudinal direction 108.

Figure 3:
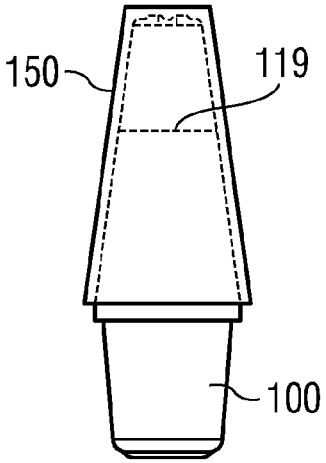
FIG. 3 shows the subsea container electrical through connector of FIG. 2 with a mounted protector, in accordance with embodiments of the herein disclosed subject matter.

FIG. 3 shows the connector 100 of FIG. 2 having a protective sleeve 150 mounted thereon. A protective sleeve 150 is advantageous since scratches may be detrimental to the function of the connector 100. This protective sleeve may only have a purpose during storage and handling and must be removed prior to installation.

Figure 4:
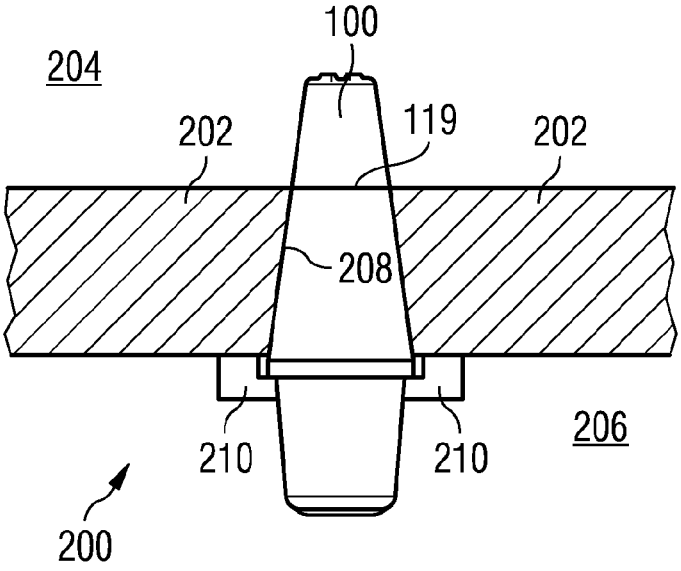
FIG. 4 shows part of a subsea container in accordance with embodiments of the herein disclosed subject matter.

FIG. 4 shows part of a subsea container 200 in accordance with embodiments of the herein disclosed subject matter.

In accordance with an embodiment, the subsea container 200 comprises a connector as disclosed herein, e.g. the connector 100 of FIG. 2. The container 200 has a container wall 202 which defines an interior 204 from an exterior 206 of the container 200. In the interior 204, a component (not shown) of a subsea electricity network is located in the interior 204 of the container 200. In accordance with a further embodiment, the wall 202 has a conical through hole 208 formed therein. In an embodiment, the through hole 208 and the connector 100 are configured such that the connector 100 penetrates a predetermined distance into the interior 204 of the container 200. In further embodiment, the through hole 208 and the connector 100 are configured such that the connector 100 inserted into the through hole 208 penetrates a further predetermined distance into the exterior 206 of the container 200. At least in the case where the container wall 202 which is made of metal, these predetermined distances are configured so as to provide sufficient insulation between the contact faces of the bolt 102 and the container wall 202.

In accordance with an embodiment, the conical hole 208 has straight walls. In other embodiments, the through hole has a conical wall portion. The conical wall portion may be a straight but conically converging wall portion. In other embodiments, the conical wall portion is not straight but generally curved. In an embodiment, the conical wall or wall portion of the through hole 208 and the conical insulator portion 138 are configured so as to have mating surfaces.

In accordance with an embodiment, the connector 100 extends between the interior 204 and the exterior 206. In other embodiments the connector 100 extends only into part of the hole. As the connector in this embodiments does not extend through the hole 208 but only penetrates the hole, such a connector is also referred to as penetrator. It is important to ensure sufficient insulating distance between the wall into which the penetrator is mounted and the bolt. In some cases this is ensured by letting the connector extend into the compartments (interior 204 and exterior 206) at both sides.

In an embodiment, the interior 204 is filled with sulfur hexafluoride at a pressure of 1.5 bar. The container 200 is configured for a water pressure at the exterior 206 of 320 bar. In an embodiment, the rated voltage for the connector is 36 kilovolts (kV). In order to fix the connector 100 to the container 200 before the connector 100 is hold in place by the water pressure at the exterior 206, a retainer 210 is provided, holding the connector 100 in place. The retainer 210 may comprise two or more brackets that are positioned around the hole 208 in the container wall 202. The brackets may be fixed to the container wall with any suitable means, e.g. screws, adhesive or by soldering, welding, etc.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate some the above described embodiments of the herein disclosed subject matter one can state:

There is provided a subsea container electrical through connector for providing an electrical connection from an interior of a subsea container to an exterior of the subsea container, wherein the connector extends partially into or fully through a hole in a subsea container. The connector comprises a conductive bolt having a conical bolt portion with an outer diameter increasing in a longitudinal direction. Further, the connector comprises an electrical insulator having a conical insulator portion with an inner surface, facing the conical bolt portion of the bolt, and an outer surface having an outer diameter which increases in the longitudinal direction.

Further, for an exemplary connector and an exemplary subsea container one can state:

In an embodiment, there is provided a penetrator to penetrate subsea switchgear canister, the penetrator comprising a conductor being arranged as a conical copper bolt and a conical cast epoxy insulating layer surrounding the conical copper bolt.

A conical copper bolt as the conductor is surrounded by a conical cast epoxy insulating layer. The one sided pressure which the penetrator is exposed to will fix the penetrator in the conical hole in a container wall (e.g. pressure canister lid), ensuring a tight fit and thus prevent any leakage from the high pressure side.

Additionally the copper bolt has a conical shape with the same purpose. For assembling purposes as well as to prevent the penetrator from becoming loose before the pressure is exposed, a fixing device will be added on the high pressure side.

The penetrator is designed for 36 kV with a differential pressure of up to 320 bar based on epoxy insulating material. This gives a very simple and reliable design, with very few parts. As pressure increases, the exposed pressure will push the penetrator into the hole ensuring a tight fit and thus prevent leakages.

In another embodiment ceramic technology could be used where ceramic and copper is brazed.

The invention claimed is:

1. A subsea container electrical through connector for providing an electrical connection from an interior of a subsea container to an exterior of the subsea container, the connector comprising:

a bolt of a conducting material, the bolt having:

a front bolt portion at a first longitudinal end of the bolt;

a first connection structure formed in the front bolt portion and configured to engage a first conductor;

a rear bolt portion at a second longitudinal end of the bolt;

a second connection structure formed in the rear bolt portion and configured to engage a second conductor;

a conical bolt portion between the front and rear bolt portions along a longitudinal direction of the bolt, the conical bolt portion having an outer diameter increasing along the longitudinal direction; and an electrical insulator having a conical insulator portion with (a) a conical inner surface facing the conical bolt portion of the bolt and (b) a conical outer surface opposite the inner surface and having an outer diameter increasing in the longitudinal direction;

wherein the conical inner surface and the conical outer surface of the electrical insulator extend substantially along a length of the conical bolt portion in the longitudinal direction of the bolt, such that a plane extending perpendicular to the longitudinal direction of the bolt and through the bolt at a longitudinal position between the first and second connector structures passes through the conical bolt portion and both the conical inner surface and the conical outer surface of the electrical insulator.

2. A connector according to claim 1, the front bolt portion defining a kink with the conical bolt portion, with an outer surface of the conical bolt portion and an outer surface of the front bolt portion abutting at the kink at an angle smaller than 180 degrees.

3. A connector according to claim 2, wherein the front bolt portion has a constant outer diameter along the longitudinal direction.

4. A connector according to claim 2, wherein the electrical insulator extends over the kink between the front bolt portion and the conical bolt portion of the bolt; and wherein the electrical insulator has a smooth outer surface portion at the longitudinal position of the kink between the front portion and the conical bolt portion of the bolt.

5. A connector according to claim 4, the rear bolt portion defining a kink with the conical bolt portion, with an outer surface of the conical bolt portion and an outer surface of the rear bolt portion abutting at the kink at an angle larger than 180 degrees.

6. A connector according to claim 5, wherein the rear bolt portion has a constant outer diameter along the longitudinal direction.

7. A connector according to claim 5, wherein the electrical insulator extends over the kink between the conical bolt portion and the rear bolt portion of the bolt; and wherein the electrical insulator further includes a rear insulator portion extending at least partially over the rear bolt portion of the bolt.

8. A connector according to claim 7, wherein the rear insulator portion has an outer diameter decreasing in the longitudinal direction.

9. A connector according to claim 1, wherein the electrical insulator further comprises a step in its longitudinal profile.

10. A connector according to claim 1, wherein at least the conical bolt portion of the bolt has a sandblasted outer surface.

11. A connector according to claim 1, wherein the electrical insulator comprises or consists of epoxy.

12. A connector according to claim 1, wherein the electrical insulator comprises or consists of ceramic.

13. A subsea container comprising:

a connector for providing an electrical connection from an interior of the subsea container to an exterior of the subsea container, the connector comprising:

a bolt of a conducting material, the bolt having:

a front bolt portion at a first longitudinal end of the bolt;

a first connection structure formed in the front bolt portion and configured to engage a first conductor;

a rear bolt portion at a second longitudinal end of the bolt;

a second connection structure formed in the rear bolt portion and configured to engage a second conductor;

a conical bolt portion between the front and rear bolt portions along a longitudinal direction of the bolt, the conical bolt portion having an outer diameter increasing along the longitudinal direction; and an electrical insulator having a conical insulator portion with (a) a conical inner surface facing the conical bolt portion of the bolt and (b) a conical outer surface opposite the inner surface and having an outer diameter increasing in the longitudinal direction;

wherein the conical inner surface and the conical outer surface of the electrical insulator extend substantially along a length of the conical bolt portion in the longitudinal direction of the bolt, such that a plane extending perpendicular to the longitudinal direction of the bolt and through the bolt at a longitudinal position between the first and second connector structures passes through the conical bolt portion and both the conical inner surface and the conical outer surface of the electrical insulator.

14. A subsea container according to claim 13, wherein the connector extends to an interior of the subsea container filled with sulfur hexafluoride.

15. A subsea container according to claim 14, wherein the connector also extends to an exterior of the subsea container which is pressurizeable, particularly up to 300 bar, while the interior of the subsea container is below 5 bar.

16. A subsea container according to claim 13, wherein the subsea container is a pressure resistant container adapted to maintain an inside pressure that is lower than an external pressure when deployed subsea, wherein the connector penetrates through a wall of the container such that the longitudinal direction in which the outer diameter of the conical insulator portion increases extends from the inside of the container to the exterior of the container.

* * * * *